US009925685B2

(12) United States Patent
Kawamura et al.

(10) Patent No.: US 9,925,685 B2
(45) Date of Patent: Mar. 27, 2018

(54) CHAINSAW

(71) Applicant: Yamabiko Corporation, Ome-shi, Tokyo (JP)

(72) Inventors: Kunimune Kawamura, Tokyo (JP); Kazuhiro Umetani, Tokyo (JP)

(73) Assignee: YAMABIKO CORPORATION, Ome-Shi (JP)

( * ) Notice: Subject to any disclaimer, the term of this patent is extended or adjusted under 35 U.S.C. 154(b) by 165 days.

(21) Appl. No.: 14/927,793

(22) Filed: Oct. 30, 2015

(65) Prior Publication Data

US 2017/0120471 A1 May 4, 2017

(51) Int. Cl.
*B27B 17/12* (2006.01)

(52) U.S. Cl.
CPC ..... *B27B 17/12* (2013.01)

(58) Field of Classification Search
CPC ..... B27B 17/12
USPC ..... 30/381–387
See application file for complete search history.

(56) References Cited

U.S. PATENT DOCUMENTS 2,621,719 A * 12/1952 Eaton ..... F02K 9/50 244/135 R
4,353,163 A * 10/1982 Overbury ..... B27B 17/12 30/123.4
4,393,589 A * 7/1983 Barkhult ..... B27B 17/00 30/381
4,444,366 A * 4/1984 Limoncelli ..... B64D 37/02 244/135 R
4,636,147 A * 1/1987 Schweitzer ..... B27B 17/12 30/123.4
4,644,658 A * 2/1987 Dolata ..... B27B 17/12 30/381
4,764,093 A * 8/1988 Nagashima ..... B27B 17/12 184/33
4,801,253 A * 1/1989 Johansson ..... F16N 13/14 184/33
4,811,487 A * 3/1989 Takahashi ..... F16D 59/00 30/382
4,928,390 A * 5/1990 Gassen ..... B27B 17/00 30/381

(Continued)

FOREIGN PATENT DOCUMENTS

DE 4107110 A1 * 9/1992 ..... B27B 17/12
FR 2673565 A1 * 9/1992 ..... B27B 17/12

(Continued)

OTHER PUBLICATIONS

European Search Report dated Apr. 11, 2016, 7 pages.

*Primary Examiner* — Jason Daniel Prone
(74) *Attorney, Agent, or Firm* — Rankin, Hill & Clark LLP

(57) ABSTRACT

A chainsaw includes a chainsaw body, a guide bar and a saw chain. The chainsaw body includes an oil tank, an oil pump to supply oil stored in the oil tank to a sliding portion between the guide bar and the saw chain, a first extension chamber arranged above the oil tank and a second extension chamber arranged above the first extension chamber. The oil tank communicates with the first extension chamber via a first flow path, the first extension chamber communicates with the second extension chamber via a second flow path and a vent hole communicating with the outer space is formed in the second extension chamber.

6 Claims, 4 Drawing Sheets

(56) References Cited

U.S. PATENT DOCUMENTS 5,184,403 A * 2/1993 Schliemann ..... B27B 17/12 30/123.4
5,236,314 A * 8/1993 Nagashima ..... B27B 17/12 184/33
5,718,050 A 2/1998 Keller et al.
5,738,064 A * 4/1998 Lowe ..... F02B 63/02 30/381
5,743,240 A * 4/1998 Zerrer ..... B27B 17/00 261/DIG. 68
6,354,006 B1 * 3/2002 Castelmani ..... B27B 17/08 30/123.4
6,490,795 B1 * 12/2002 Krahn ..... B27B 17/12 30/123.4
6,622,387 B2 * 9/2003 Uhl ..... B27B 17/00 30/383
6,787,028 B2 * 9/2004 Uhl ..... B27B 17/00 210/171
7,806,107 B2 * 10/2010 Knauβ et al. ..... F02M 37/0017 30/381
8,210,134 B2 * 7/2012 Shimokawa ..... B27B 17/00 30/381
8,225,776 B2 * 7/2012 Kawamura ..... B27B 17/00 123/41.56
8,256,458 B2 * 9/2012 Angst ..... F01D 25/18 137/590
8,844,678 B2 * 9/2014 Ilmarinen ..... B27B 17/12 184/6.14
8,935,856 B2 * 1/2015 Tsuruoka ..... B27B 17/00 30/381
9,644,618 B2 * 5/2017 Hirai ..... F04B 9/02 184/6.14
2009/0000130 A1 * 1/2009 Shimokawa ..... B27B 17/00 30/383
2009/0100689 A1 * 4/2009 Shimokawa ..... B27B 17/0033 30/381
2010/0043234 A1 * 2/2010 Pellenc ..... B27B 17/12 30/123.4
2015/0298344 A1 10/2015 Hallendorff et al.
2015/0336288 A1 * 11/2015 Hallendorff ..... B27B 17/12 30/383
2016/0047401 A1 * 2/2016 Takayanagi ..... F04B 53/16 92/31
2016/0265491 A1 * 9/2016 Kawamura ..... F02M 35/0226 123/434

FOREIGN PATENT DOCUMENTS

JP 2014-216199 10/2014
WO 2014/070052 5/2014
WO WO 2014070052 A1 * 5/2014 ..... B27B 17/12

* cited by examiner

CHAINSAW

BACKGROUND OF INVENTION

1. Technical Field

The present invention relates to a chainsaw having an oil tank.

2. Related Art

In chainsaws used to cut trees, wooden boards or the like, it is required to supply oil for lubrication to a sliding portion between a guide bar and a saw chain, since the saw chain rotates around a periphery of the guide bar at high speed. To this end, the chainsaw is provided with an oil pump that suctions oil stored in an oil tank and supplies the suctioned oil to the sliding portion between the guide bar and the saw chain.

When the oil pump suctions out the oil stored in the oil tank to produce a negative pressure in the oil tank, the oil pump can no longer suction the oil and it is hard to remove a cap from an opening of the oil tank.

Therefore, an oil tank having a one-way valve that allows the flow only in a direction of suction from an outer space is known as one of conventional oil tanks for the chainsaw (see, for example, the Patent Document 1 below).

In this constitution, the negative pressure is prevented from being produced in the oil tank, since the air flows from the outer space into the oil tank in accordance with a decrease in the oil in the oil tank.

Patent Document 1: WO 2014/070052 A1

In the aforementioned conventional chainsaw, although the negative pressure can be prevented from being produced in the oil tank while the oil pump is operated, the pressure in the oil tank rises when the oil thermally expands due to heat of an engine, an exhaust muffler and the like. In this situation, since the one-way valve of the oil tank allows the flow only in the direction of suction from the outer space, the pressure in the oil tank becomes high. In addition, the pressure in the oil tank becomes even higher when the operation of the chainsaw is stopped and thereby discharge of the oil from the oil pump is stopped. Thus, there arises a problem of an oil leak from the discharge port of the oil pump caused by such higher pressure in the oil tank.

A conventional chainsaw having in a breather of the oil tank a two-way valve that allows the flow in directions of discharge to and suction from the outer space is also known. In this constitution, although the oil does not leak from the oil pump side even if the pressure in the oil tank becomes higher, the oil sometimes leaks from the breather when the pressure in the oil tank rises due to temperature rise or the like, if an amount of the oil stored in the oil tank is large.

Furthermore, chainsaws are often tilted or inverted up and down when used or transported, and in this case, the oil sometimes leaks from the breather which is formed directly on the oil tank in the constitution where the two-way valve is used.

SUMMARY OF INVENTION

An object of the present invention is to solve the above problem and to provide a chainsaw that can prevent the pressure in the oil tank from becoming high and from becoming negative and can prevent occurrence of the oil leak due to thermal expansion of the oil and the air in the oil tank.

In order to solve the above problem, a chainsaw of the present invention includes a chainsaw body, a guide bar detachably attached to the chainsaw body, and a saw chain wound around a periphery of the guide bar. The chainsaw body includes an oil tank, an oil pump to supply oil stored in the oil tank to a sliding portion between the guide bar and the saw chain, a first extension chamber arranged above the oil tank, and a second extension chamber arranged above the first extension chamber. The oil tank communicates with the first extension chamber via a first flow path, the first extension chamber communicates with the second extension chamber via a second flow path, and a vent hole communicating with an outer space is formed in the second extension chamber.

In this constitution, since the interior of the oil tank communicates with the outer space via the extension chambers and the flow paths, the pressure in the oil tank can be prevented from becoming high and from becoming negative.

Since the pressure in the oil tank can be prevented from becoming high and from becoming negative in the chainsaw of the present invention in this way, the oil can be prevented from leaking from the discharge port of the oil pump, after the operation of the chainsaw is stopped and thereby the discharge of the oil from the oil pump is stopped.

When the oil or the air in the oil tank thermally expands, or when the chainsaw is tilted or inverted up and down, the oil in the oil tank will flow into the first extension chamber. However, since the second extension chamber having the vent hole is apart from the oil tank in the height direction via the first extension chamber, it is hard for the oil to flow out of the oil tank into the second extension chamber, and therefore, the oil leak from the vent hole of the second extension chamber can be prevented.

In the chainsaw of the present invention, the first extension chamber and the second extension chamber are arranged above the oil tank. Therefore, if the chainsaw is placed in a posture of normal use or storage (in a posture where both of the extension chambers are located above the oil tank), the oil having flowed into the extension chambers will also flow down along the flow paths to return to the oil tank. In this way, the oil can be prevented from leaking to the outside.

Furthermore, in the chainsaw of the present invention, since the oil tank and both of the extension chambers can be integrally formed in a member such as a crank case of the engine, the oil leak can be prevented only by forming two extension chambers in the chainsaw body, without adding new parts to a conventional chainsaw.

Details of members constituting the chainsaw other than the oil tank, both extension chambers and both flow paths are not limited in the present invention. For example, the invention can be applied to an engine-powered chainsaw where the chainsaw body has an engine for driving the saw chain. In addition, the invention can also be applied to an electrically motorized chainsaw where the chainsaw body has an electric motor for driving the saw chain.

In the case where a filter having breathability is arranged in the vent hole so that intake and exhaust are performed between the second extension chamber and the outer space through the filter in the aforementioned chainsaw, dust and dirt are surely prevented from entering the oil tank from the outer space.

It is preferable that an oil storage capacity of the first extension chamber is equal to or more than 5% of an oil storage capacity of the oil tank in the aforementioned chainsaw. The oil storage capacity means a maximum amount of oil storable in the first extension chamber or in the oil tank.

By designing the oil storage capacity of the first extension chamber as mentioned above, even if the oil thermally expands while the oil tank is filled with the oil, all of the oil having flown out of the oil tank can be stored in the first extension chamber.

In the case where at least one of the first flow path and the second flow path is constituted of a tubular member in the aforementioned chainsaw, the oil tank and both extension chambers can be arranged further apart in height positions. Therefore, the degree of freedom of layout of the oil tank and both extension chambers can be enhanced and the path length from the oil tank to the second extension chamber can be lengthened.

In the case where the chain saw body includes an engine for driving the saw chain and an exhaust muffler connected to the engine in the aforementioned chainsaw, it is preferable that the oil tank and at least one of the first extension chamber and the second extension chamber are arranged between a drive part of the engine and the exhaust muffler.

In this constitution, the heat of the exhaust muffler is blocked by the oil in the oil tank and the air in the extension chambers, and thus, the heat of the exhaust muffler is prevented from being transferred to parts in the drive part and a carburetor.

In addition, since the oil tank and the extension chambers are arranged effectively utilizing a space between the drive part of the engine and the exhaust muffler, increase in size of the chainsaw body can be prevented.

The oil tank and the extension chambers may be formed in a wall of the crank case included in the engine, or may be formed separately from the crank case.

In the aforementioned chainsaw, the chainsaw body may include an engine for driving the saw chain, and the crank case of the engine may have left and right case members. In this case, by dividedly forming the oil tank and the first extension chamber over both of the case members, and by forming the first flow path in a connection between both of the case members, the first flow path can be formed in the crank case in a simpler constitution. Thus, this constitution is beneficial in point of view of easy assembly and the number of parts of the chainsaw.

In addition, in the aforementioned constitution, since the first extension chamber is formed on the left and the right sides of the first flow path, the oil in the first extension chamber will stay in the left or right side part of the first extension chamber, even while the chainsaw is tilted, and thus, the oil is not likely to flow out of the first extension chamber into the second extension chamber.

In the chainsaw of the present invention, since the oil tank communicates with the outer space via two extension chambers, the pressure in the oil tank can be prevented from becoming high or from becoming negative, and the oil leak can be prevented.

DETAILED EXPLANATION OF EMBODIMENTS

Embodiments of the present invention will now be described in detail with reference to appropriate drawings.

Figure 1:
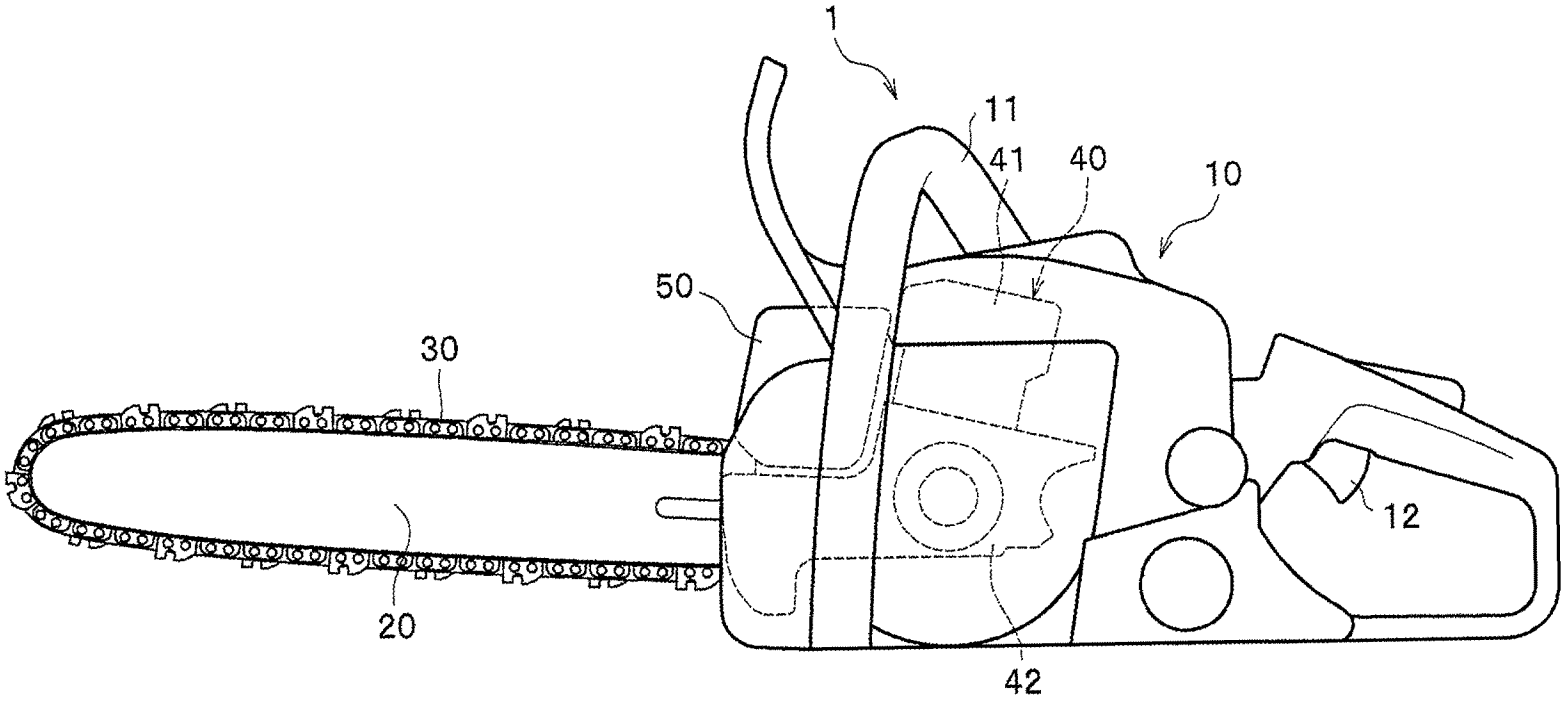
FIG. 1 is a side view showing a chainsaw according to an embodiment of the present invention.

A chainsaw 1 according to an embodiment of the present invention comprises a chainsaw body 10, a guide bar 20 detachably attached to the chainsaw body 10 and a saw chain 30 wound around a periphery of the guide bar 20, as shown in FIG. 1. The chainsaw 1 is depicted in an upright state in FIG. 1.

Figure 3:
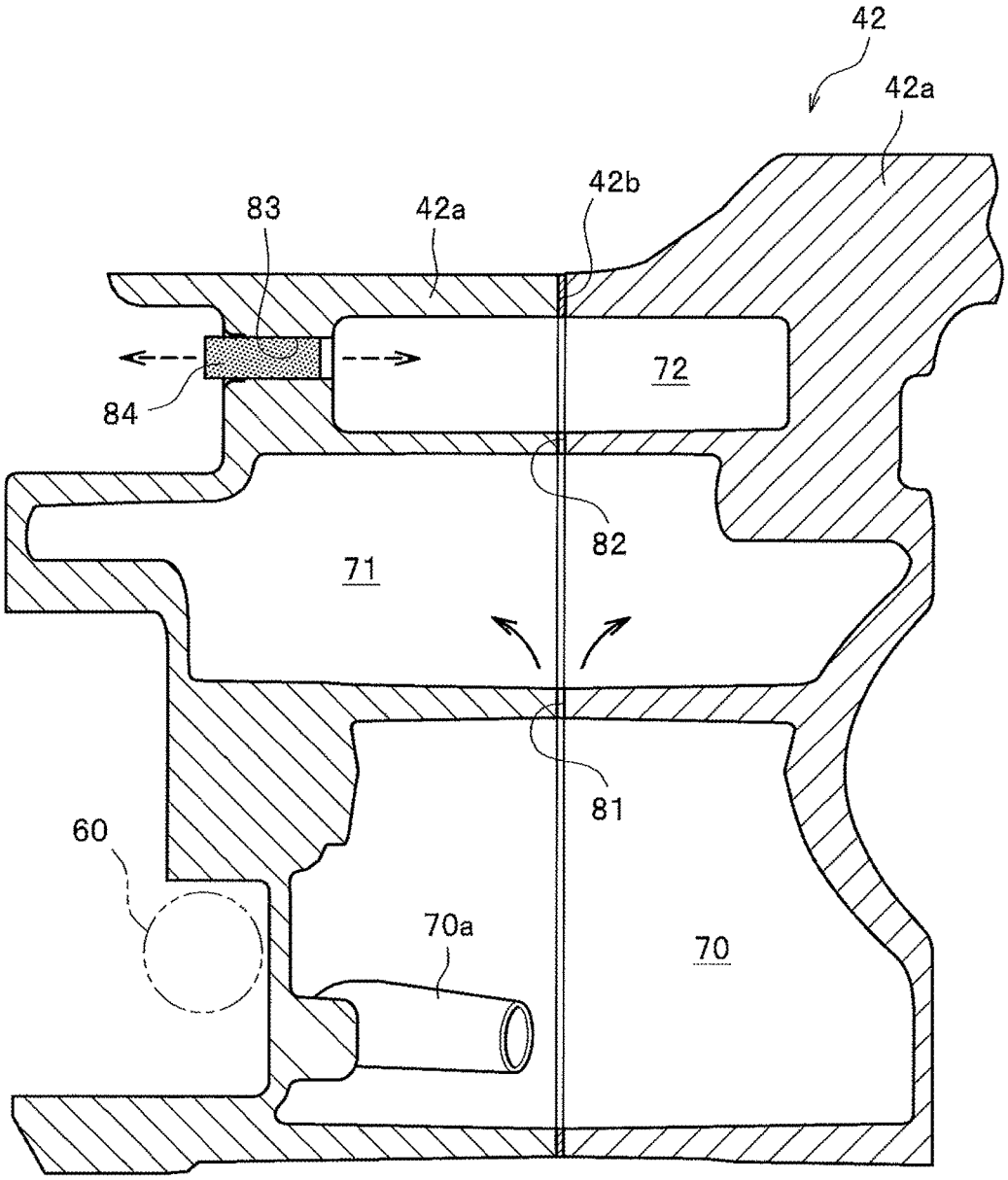
FIG. 3 is a cross-sectional view taken along the arrow line A-A of FIG. 2.

The chainsaw body 10 includes an engine 40 for driving the saw chain 30 to rotate, an exhaust muffler 50 through which an exhaust gas exhausted from the engine 40 passes, and an oil pump 60 for supplying the oil to a sliding portion between the guide bar 20 and the saw chain 30 (see FIG. 3).

Detailed explanation on the whole constitution of the chainsaw 1 is omitted since the chainsaw 1 according to the embodiment has a constitution similar to conventionally known chainsaws except for constitutions of an oil tank 70 and extension chambers 71, 72 (see FIGS. 2 and 3) which will be explained later. In the explanation below, the word "front" indicates the front end side of the guide bar 20 (the left side of FIG. 1).

Figure 2:
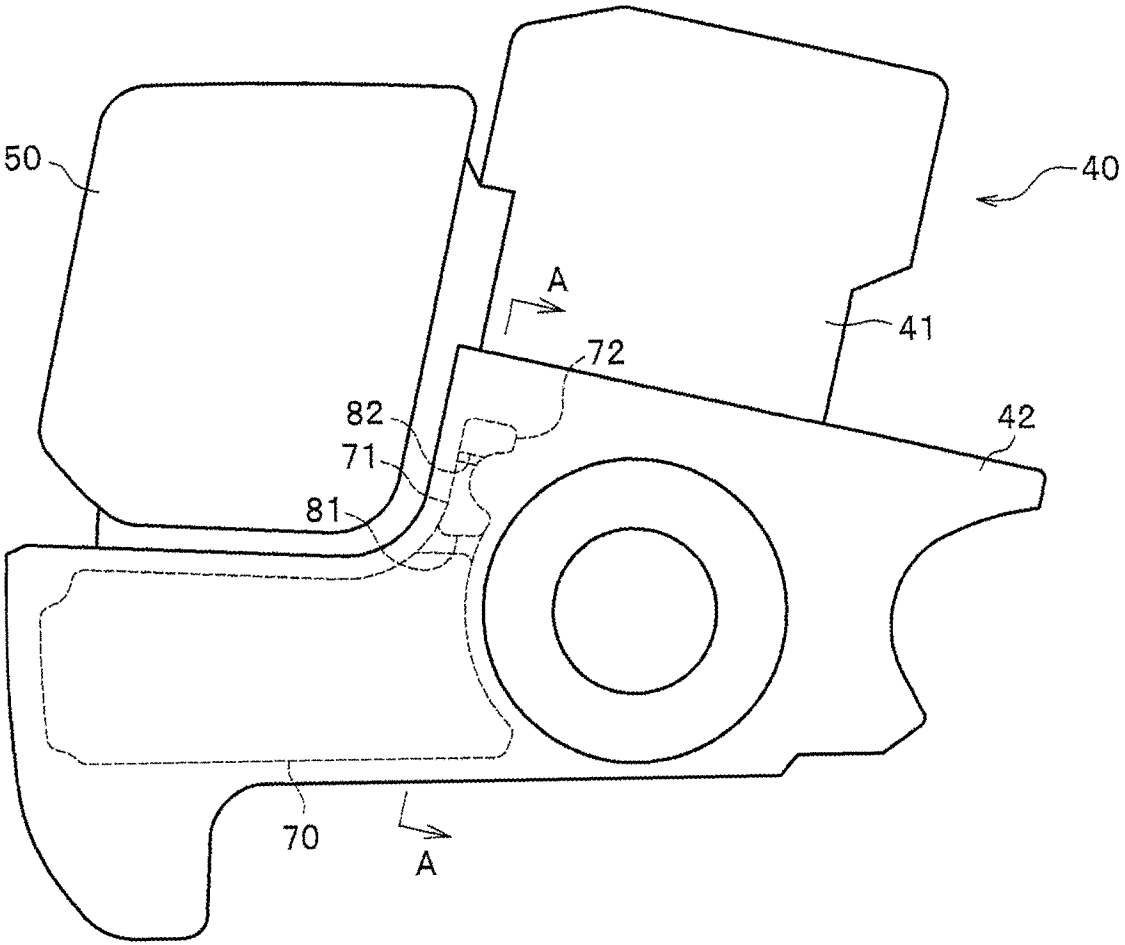
FIG. 2 is a side view showing an engine and an exhaust muffler according to the embodiment of the present invention.

The engine 40 is an internal combustion engine having a cylinder block 41 and a crank case 42, as shown in FIG. 2. The crank case 42 is divided into left, and right case members 42*a*, 42*a* and a gasket 42*b* is sandwiched between the case members 42*a*, 42*a*, as shown in FIG. 3. The exhaust muffler 50 is a box-shaped silencer arranged in front of the cylinder block 41 and above a front portion of the crank case 42 as shown in FIG. 2. The exhaust muffler 50 is connected to an exhaust port of the cylinder block 41.

In addition, the chainsaw body 10 is provided with a front handle 11 for being gripped when the chainsaw 1 is carried and a throttle lever 12 for adjusting an output of the engine 40, as shown in FIG. 1.

An oil pump 60 is provided in a front part of a right side portion of the chainsaw body 10, as shown in FIG. 3. A drive shaft of the oil pump 60 is linked to a crank shaft of the engine 40 and thereby the oil pump 60 is driven by a driving force of the engine 40.

The oil pump 60 suctions oil stored in an oil tank 70 explained later and supplies the oil through a discharge port (not shown) provided on the side of the guide bar 20 to an oil groove (not shown) of the guide bar 20 (see FIG. 1).

The oil then flows out of the oil groove to an outer surface of the guide bar 20 shown in FIG. 1, and thereby the oil is supplied to the sliding portion between the guide bar 20 and the saw chain 30.

The guide bar 20 is a plate-like member lengthened in a front-rear direction and a rear thereof is attached to a front of the chainsaw body 10.

The saw chain 30 is an annular cutting member which is wound around a periphery of the guide bar 20 and a rear of the saw chain 30 is turned over a sprocket (not shown) of the engine 40, and thereby, the saw chain 30 is driven by the driving force of the engine 40 to rotate along the periphery of the guide bar 20.

An oil tank 70, the first extension chamber 71 and the second extension chamber 72 are formed in the crank case 42 of the engine 40, as shown in FIG. 2.

The oil tank 70 and both of the extension chambers 71, 72 are formed in a wall on the side of the exhaust muffler 50 in the crank case 42.

The oil tank 70 is formed in a lower portion of the crank case 42, the first extension chamber 71 is formed above the oil tank 70, and further, the second extension chamber 72 is formed above the first extension chamber 71.

The oil tank 70 and both of the extension chambers 71, 72 are arranged between a drive part of the engine 40 and the exhaust muffler 50.

The drive part of the engine 40 is an internal structure of the engine 40 and is a region consisting of driven parts in the engine 40 (for example, piston, connecting rod, crank shaft, and the like).

The oil tank 70 is a region for storing the oil which is to be supplied to the sliding portion between the guide bar 20 and the saw chain 30. As shown in FIG. 3, the oil tank 70 is dividedly formed over both of the case members 42*a*, 42*a*. Left and right regions of the oil tank 70 are formed so as to have substantially the same size as each other.

An exhaust pipe 70*a* communicating with a suction port of the oil pump 60 is provided in a bottom of the oil tank 70. Accordingly, the oil in the oil tank 70 is suctioned out through the exhaust pipe 70*a* by the oil pump 60 and is supplied to the sliding portion between the guide bar 20 and the saw chain 30.

The first extension chamber 71 is a region for storing the oil flowing out of the oil tank 70. The first extension chamber 71 is dividedly formed over both of the case members 42*a*, 42*a*. Left and right regions of the first extension chamber 71 are formed so as to have substantially the same size as each other.

It should be noted that an oil storage capacity of the first extension chamber 71 is designed to be preferably equal to or more than 5% of an oil storage capacity of the oil tank 70. In this embodiment, the oil storage capacity of the first extension chamber 71 is designed to be 7% of the oil storage capacity of the oil tank 70.

The oil tank 70 and the first extension chamber 71 communicate with each other via a first flow path 81.

The first flow path 81 is formed in a connection between both of the case members 42*a*, 42*a*. Concretely, the first flow path 81 is formed of a gap between joint surfaces of both of the case members 42*a*, 42*a*.

In the present embodiment, the gap serving as the first flow path 81 formed between the joint surfaces of both of the case members 42*a*, 42*a* is formed by not providing in a region serving as the first flow path 81 the gasket 42*b* which is to be sandwiched between both of the case members 42*a*, 42*a*.

The first flow path 81 may also be formed by forming a concave in an appropriate portion of the joint surface of a case member 42*a*.

The first flow path 81 of the present embodiment is a slit groove lengthened in a front-rear direction and its width in a left-right direction is approximately 0.2 mm. Since the first flow path 81 is so narrow that it is difficult for the oil having viscosity to pass through, while the air is allowed to pass through. This makes it difficult for the oil in the oil tank 70 to flow out through the first extension chamber 71 and the second extension chamber 72, while the pressure in the oil tank 70 is rapidly regulated.

The first flow path 81 is formed from the middle of the oil tank 70 in the left-right direction over to the middle of the first extension chamber 71 in the left-right direction. Accordingly, the oil tank 70 and the first extension chamber 71 are formed on the left and right sides of the first flow path 81.

More specifically, the first flow path 81 is formed drastically narrower in the left-right direction than the oil tank 70 and the first extension chamber 71 whose widths are substantially the same as the width of the chainsaw body 10 in the left-right direction (approximately 200 mm in the present embodiment).

The second extension chamber 72 is dividedly formed over both of the case members 42*a*, 42*a*. Left and right regions of the second extension chamber 72 are formed so as to have substantially the same size as each other.

The first extension chamber 71 and the second extension chamber 72 communicate with each other via a second flow path 82.

The second flow path 82 is formed in a connection between both of the case members 42*a*, 42*a*. Concretely, the second flow path 82 is formed of a gap between joint surfaces of both of the case members 42*a*, 42*a*.

In the present embodiment, the gap serving as the second flow path 82 formed between the joint surfaces of both of the case members 42*a*, 42*a* is formed by not providing in a region serving as the second flow path 82 the gasket 42*b* which is to be sandwiched between both of the case members 42*a*, 42*a*.

The second flow path 82 may also be formed by forming a concave in an appropriate portion of the joint surface of a case member 42*a*.

The second flow path 82 of the present embodiment is a slit groove lengthened in the front-rear direction and its width in the left-right direction is approximately 0.2 mm, similarly to the first flow path 81.

The second flow path 82 is formed from the middle of the first extension chamber 71 in the left-right direction over to the middle of the second extension chamber 72 in the left-right direction. Accordingly, the first extension chamber 71 and the second extension chamber 72 are formed on left and right sides of the second flow path 82.

More specifically, the second flow path 82 is formed drastically narrower in the left-right direction than the oil tank 70 and the first extension chamber 71.

A vent hole 83 communicating with an outer space is formed in the right side wall of the second extension chamber 72. The vent hole 83 is a cylindrical hole that opens in the side face (the right side face) of the crank case 42 on the side of the guide bar 20.

A filter 84 is inserted into the vent hole 83. The filter 84 is a member having breathability, such as a sintered metal, a sponge, or the like. Since the filter 84 is breathable in two directions, intake and exhaust are performed between the outer space and the second extension chamber 72 through the filter 84.

By providing the filter 84 in the vent hole 83, dust and dirt are surely prevented from entering from the outer space into both of the extension chambers 71, 72 and the oil tank 70.

In the chainsaw 1 as mentioned above, since the interior of the oil tank 70 communicates with the outer space via both of the extension chambers 71, 72 and both of the flow paths 81, 82, the pressure in the oil tank 70 can be prevented from becoming high and from becoming negative.

As mentioned above, in the chainsaw 1, since the pressure in the oil tank 70 can be prevented from becoming high, the oil can be prevented from leaking from the discharge port of the oil pump 60, after the operation of the chainsaw 1 is stopped and thereby the discharge of the oil from the oil pump 60 is stopped.

When the oil or the air in the oil tank thermally expands, or when the chainsaw 1 is tilted or inverted up and down, the oil in the oil tank 70 will flow into the first extension chamber 71. However, since the second extension chamber 72 having the vent hole 83 is apart from the oil tank 70 in a height direction via the first extension chamber 71, there is provided a structure in which it is hard for the oil to flow out of the oil tank 70 into the second extension chamber 72.

Note that, since the first extension chamber 71 is formed on the left and right sides of the first flow path 81, the oil will stay in the left or right side part of the first extension chamber 71, even while the chainsaw 1 is tilted.

Further, in the chainsaw 1, both of the extension chambers 71, 72 are arranged above the oil tank 70, and the first flow path 81 and the second flow path 82 are formed to be narrow.

Therefore, in the chainsaw 1, since the oil is difficult to flow out of the oil tank 70 into the second extension chamber 72, the oil can be prevented from leaking from the vent hole 83 of the second extension chamber 72 to the external.

In addition, in the chainsaw 1, since the oil storage capacity of the first extension chamber 71 is designed to be equal to or more than 5% of the oil storage capacity of the oil tank 70, even if the oil thermally expands while the oil tank 70 is filled with the oil, all of the oil flowing out of the oil tank 70 can be stored in the first extension chamber 71.

Furthermore, in the chainsaw 1, since the oil tank 70 and both of the extension chambers 71, 72 can be integrally formed in the crank case 42 of the engine 40, the oil leak can be prevented without adding new parts to a conventional chainsaw.

In addition, in the chainsaw 1, both of the flow paths 81, 82 can be formed in the crank case 42 in a simpler configuration because both of the flow paths 81, 82 are formed in a connection between both of the case members 42*a*, 42*a*. Thus, this configuration is beneficial in point of view of easy assembly and the number of parts of the chainsaw 1.

Meanwhile, in the chainsaw 1, the first extension chamber 71 is arranged above the oil tank 70. Therefore, if the chainsaw 1 is placed in a posture of normal use or storage (in a posture where both of the extension chambers 71, 72 are arranged above the oil tank 70), the oil having flowed into the first extension chamber 71 will also flow down along the first flow path 81 to return to the oil tank 70. In this way, the oil can be prevented from leaking to the outside.

In addition, in the chainsaw 1, the oil tank 70 and both of the extension chambers 71, 72 are arranged between the drive part of the engine 40 and the exhaust muffler 50, as shown in FIG. 2. This enables the oil in the oil tank 70 and the air in both of the extension chambers 71, 72 to block the heat of the exhaust muffler 50, and thus, the heat of the exhaust muffler 50 is prevented from being transferred to parts in the drive part and a carburetor.

Further, in the chainsaw 1, since the oil tank 70 and both of the extension chambers 71, 72 are arranged effectively utilizing a space between the drive part of the engine 40 and the exhaust muffler 50, increase in size of the chainsaw body 10 (see FIG. 1) can be prevented.

Although an embodiment of the present invention have been explained above, the present invention is not limited to the embodiment, but can be appropriately modified without departing from its essence.

Although both of the flow paths 81, 82 are formed in the connection between both of the case members 42*a*, 42*a* in the chainsaw 1 of the embodiment, as shown in FIG. 3, the region where both of the flow paths 81, 82 are formed is not limited to this.

Figure 4:
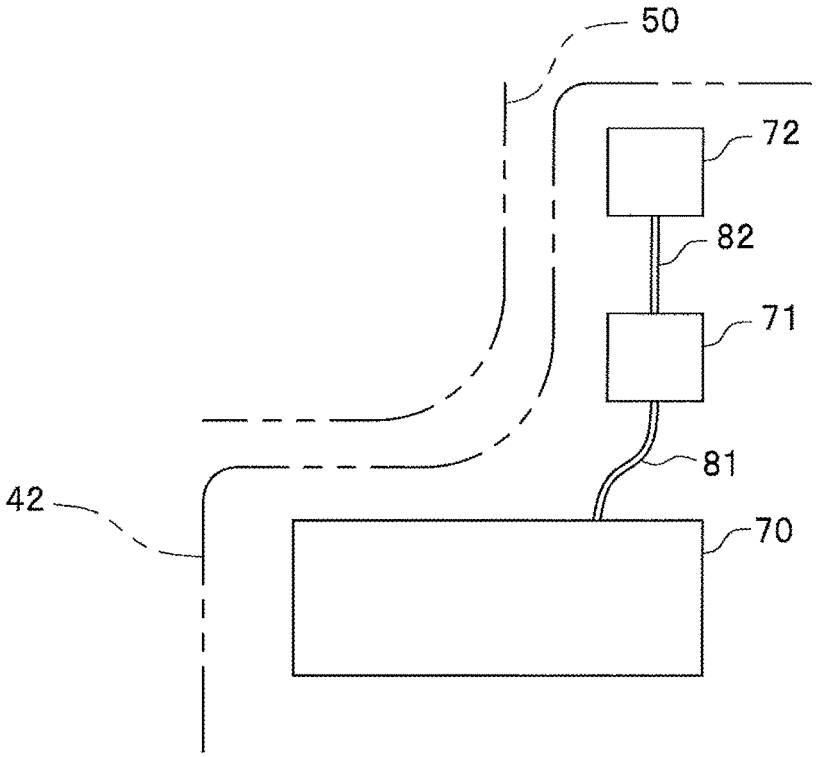
FIG. 4 is a schematic view of another embodiment of the present invention, wherein the flow paths are configured using tubular members.

If the first flow path 81 and the second flow path 82 are constituted of tubular members such as pipes, hoses, or the like, as shown in FIG. 4, the oil tank 70 and both of the extension chambers 71, 72 can be arranged more apart from each other in height positions. In this case, the degree of freedom of layout of the oil tank 70 and both of the extension chambers 71, 72 can be enhanced and the path length from the oil tank 70 to the second extension chamber 72 can be lengthened.

Although both of the first flow path 81 and the second flow path 82 are constituted of tubular members in FIG. 4, only one of the first flow path 81 and the second flow path 82 may be constituted of a tubular member.

In the chainsaw 1 according to the embodiment, the oil tank 70 and both of extension chambers 71, 72 are formed in the crank case 42, as shown in FIG. 2. However, the oil tank 70 and both of the extension chambers 71, 72 may be formed in another region of the engine 40.

Further, the oil tank 70 and both of the expansion chambers 71, 72 may be provided separately from the crank case 42. In this embodiment, the oil tank 70 and both of the expansion chambers 71, 72 can be arranged in a front part or a rear part of the chainsaw body 10 according to an internal structure of the chainsaw body 10.

Although both of the extension chambers 71, 72 are arranged between the drive part of the engine 40 and the exhaust muffler 50 in the chainsaw 1 of the present embodiment, only one of the extension chambers 71, 72 may be arranged between the drive part of the engine 40 and the exhaust muffler 50.

Further, although one first extension chamber 71 and one second extension chamber 72 are provided in the chainsaw body 10, in the chainsaw 1 of the present embodiment, each of the first extension chamber 71 and the second extension chamber 72 may be provided in a plurality of places. In this case a total oil storage capacity of the plurality of the first extension chambers 71 has only to be designed to be equal to or more than 5% of the oil storage capacity of the oil tank 70.

Furthermore, although the engine-powered chainsaw 1 where the chainsaw body 10 has the engine 40 for driving the saw chain 30 have been explained in the present embodiment, members constituting the chainsaw other than the oil tank, both of the extension chambers and both of the flow paths are not limited to the chainsaw of the present invention. Accordingly, the present invention can be applied to an electric chainsaw where the chainsaw body has an electric motor for driving the saw chain.

EXPLANATION OF REFERENCE NUMERALS

1 Chainsaw
10 Chainsaw Body
20 Guide Bar
30 Saw Chain
40 Engine
41 Cylinder Block
42 Crank Case
42*a* Case Member
50 Exhaust Muffler
60 Oil Pump
61 Discharge Port
70 Oil Tank
71 First Extension Chamber
72 Second Extension Chamber
81 First Flow Path
82 Second Flow Path
83 Vent Hole
84 Filter

What is claimed is:

1. A chainsaw comprising:

a chainsaw body;

a guide bar detachably attached to the chainsaw body; and a saw chain wound around a periphery of the guide bar, the chainsaw body including:

an oil tank;

an oil pump to supply oil stored in the oil tank to a sliding portion between the guide bar and the saw chain;

a first extension chamber arranged above the oil tank when the chainsaw is in an upright state; and a second extension chamber arranged above the first extension chamber when the chainsaw is in the upright state, wherein the oil tank communicates with the first extension chamber via a first flow path, the first extension chamber communicates with the second extension chamber via a second flow path, a vent hole formed in the second extension chamber communicates the second extension chamber with an external space outside the chainsaw body, a filter having breathability so that intake and exhaust of air can be performed is arranged in the vent hole, and wherein the vent hole performs the intake and the exhaust between the second extension chamber and the external space through the filter.

2. The chainsaw as claimed in claim 1, wherein the chainsaw body further includes an engine for driving the saw chain, the engine including a drive part, and an exhaust muffler connected to the engine, wherein the oil tank and at least one of the first extension chamber and the second extension chamber are arranged between the drive part of the engine and the exhaust muffler.

3. The chainsaw as claimed in claim 1, wherein the chainsaw body further includes an engine for driving the saw chain, the engine having a crank case, the crank case of the engine has two case members disposed on left and right sides of the engine when the chainsaw is in the upright state, the oil tank, the first extension chamber, and the second extension chamber are dividedly formed to be both of the case members, and the first flow path and the second flow path are formed in a connection between both of the case members.

4. The chainsaw as claimed in claim 1, wherein the chainsaw body further includes an electric motor for driving the saw chain.

5. A chainsaw comprising:

a chainsaw body;

a guide bar detachably attached to the chainsaw body; and a saw chain wound around a periphery of the guide bar, the chainsaw body including:

an engine for driving the saw chain, the engine having a crank case with two case members disposed on left and right sides of the engine when the chainsaw is in an upright state;

an oil tank;

an oil pump to supply oil stored in the oil tank to a sliding portion between the guide bar and the saw chain;

a first extension chamber arranged above the oil tank when the chainsaw is in the upright state; and a second extension chamber arranged above the first extension chamber when the chainsaw is in the upright; state, wherein the oil tank communicates with the first extension chamber via a first flow path, the first extension chamber communicates with the second extension chamber via a second flow path, a vent hole formed in the second extension chamber communicates the second extension chamber with an external space outside the chainsaw body, the oil tank, the first extension chamber, and the second extension chamber are dividedly formed to be both of the case members, and the first flow path and the second flow path are formed in a connection between both of the case members.

6. The chainsaw as claimed in claim 5, wherein an oil storage capacity of the first extension chamber is equal to or more than 5% of an oil storage capacity of the oil tank.

* * * * *